US008690019B2

(12) United States Patent
Defemme et al.

(10) Patent No.: US 8,690,019 B2
(45) Date of Patent: Apr. 8, 2014

(54) HEAD FOR DISPENSING A LIQUID AS A DRIP

(71) Applicants: Alain Defemme, Chamalieres (FR); Fabrice Mercier, Clermont-Ferrand (FR)

(72) Inventors: Alain Defemme, Chamalieres (FR); Fabrice Mercier, Clermont-Ferrand (FR)

(73) Assignee: Laboratoires Thea (FR)

( * ) Notice: Subject to any disclaimer, the term of this patent is extended or adjusted under 35 U.S.C. 154(b) by 0 days.

(21) Appl. No.: 13/754,532

(22) Filed: Jan. 30, 2013

(65) Prior Publication Data

US 2013/0134186 A1 May 30, 2013

Related U.S. Application Data

(63) Continuation of application No. PCT/IB2011/001741, filed on Jul. 28, 2011.

(30) Foreign Application Priority Data

Jul. 30, 2010 (FR) ..... 10 03233

(51) Int. Cl.
*B67D 7/76* (2010.01)

(52) U.S. Cl.
USPC . 222/189.11; 222/213; 222/214; 222/189.06; 222/422; 137/513.5

(58) Field of Classification Search
USPC ..... 222/212–215, 491, 495, 567–570, 222/420–422, 189.06, 189.08–189.09, 222/189.11; 215/11.4, 308, 312; 137/513.5, 137/533.11; 251/125
See application file for complete search history.

(56) References Cited

U.S. PATENT DOCUMENTS

| | | | | |
|---|---|---|---|---|
| 1,762,059 | A * | 6/1930 | Jones | 222/422 |
| 2,168,297 | A * | 8/1939 | Voke | 222/496 |
| 2,321,369 | A * | 6/1943 | Dubilier | 604/217 |
| 3,149,758 | A * | 9/1964 | Bush et al. | 222/189.09 |
| 3,189,223 | A * | 6/1965 | Mackal | 222/1 |

(Continued)

FOREIGN PATENT DOCUMENTS

| | | | |
|---|---|---|---|
| EP | 0132715 | A2 | 2/1985 |
| EP | 1538099 | A1 | 6/2005 |
| WO | 03089325 | A2 | 10/2003 |

OTHER PUBLICATIONS

International Search Report Application No. PCT/PCT/IB2011/001741 Completed: Jun. 18, 2012; Mailing Date: Jun. 28, 2012 2 pages.

*Primary Examiner* — Paul R Durand
*Assistant Examiner* — Randall Gruby
(74) *Attorney, Agent, or Firm* — St. Onge Steward Johnston & Reens LLC

(57) ABSTRACT

A head for dispensing liquid as a drip, includes a nozzle onto which a channel for ejecting the liquid leads. Air sucked in from the outside is returned through the channel in the opposite direction. In the nozzle, on the ejection channel, the drip dispensing head of the invention includes a valve functioning as a non-return valve for the circulation of the liquid being ejected. A mobile disc of the valve is produced so as to selectively enable air to pass through the valve when the disc is bearing against the seat thereof in a position for closing the liquid ejection channel. The disc is returned to the position by negative pressure applied upstream, which tends to suck in outside air. The disc is advantageously made of a microporous material, which provides antibacterial filtering of the return air.

14 Claims, 2 Drawing Sheets

(56) References Cited

U.S. PATENT DOCUMENTS

| | | | | | |
|---|---|---|---|---|---|
| 3,520,330 | A * | 7/1970 | Szwargulski | 137/613 |
| 3,794,213 | A * | 2/1974 | Schwartzman | 222/107 |
| 3,826,281 | A * | 7/1974 | Clark | 137/625.31 |
| 5,033,647 | A * | 7/1991 | Smith et al. | 222/94 |
| 5,238,153 | A * | 8/1993 | Castillo et al. | 222/189.09 |
| 5,507,417 | A * | 4/1996 | Webb | 222/189.11 |
| 5,588,559 | A * | 12/1996 | Vallet Mas et al. | 222/92 |
| 5,609,759 | A * | 3/1997 | Nohren et al. | 210/266 |
| 5,611,464 | A * | 3/1997 | Tsao et al. | 222/189.06 |
| 6,336,571 | B1 * | 1/2002 | Chibret et al. | 222/189.09 |
| 6,688,495 | B2 * | 2/2004 | Masuda | 222/92 |
| 6,981,516 | B1 * | 1/2006 | VanOsdol | 137/519.5 |
| 7,140,517 | B2 * | 11/2006 | Masuda | 222/213 |
| 7,427,355 | B2 * | 9/2008 | Chau | 210/266 |
| 8,485,398 | B2 * | 7/2013 | Kneer | 222/494 |
| 2004/0074925 | A1 * | 4/2004 | Faurie | 222/212 |
| 2006/0124170 | A1 * | 6/2006 | Schaefer et al. | 137/68.19 |
| 2007/0028988 | A1 * | 2/2007 | Mihashi et al. | 139/383 A |
| 2007/0164051 | A1 * | 7/2007 | Mijers et al. | 222/189.06 |
| 2008/0067194 | A1 * | 3/2008 | Faurie | 222/189.07 |
| 2009/0152302 | A1 * | 6/2009 | Grevin | 222/189.06 |

* cited by examiner

HEAD FOR DISPENSING A LIQUID AS A DRIP

FIELD OF THE INVENTION

The present invention relates to the design and production of such bottle devices as used for the drop-by-drop delivery of a liquid contained in a sealed reservoir. More particularly, it relates to bottles closed off by a delivery head through which the air that enters the reservoir to replace a fraction of liquid that has been extracted therefrom follows the same path as the previously expelled liquid.

BACKGROUND OF THE INVENTION

Bottles of this type have been described under several concrete embodiments in various earlier patents of the same applicant company. In these bottles, a bifunctional membrane is placed at one end of the expulsion channel, upstream of the path for the expelled liquid, in order to allow an alternation between the passage of the expelled liquid and the passage of the entering air. The same membrane is used as an anti-bacterial membrane preventing the passage of impurities when air enters back into the bottle. It is a constant objective of the applicant to propose bottle assemblies allowing the absence of external contamination of the liquid contained in the reservoir. It is further a constant purpose of the applicant to ensure the delivery of drops conveniently shaped and calibrated, without any leakage, and that purpose find benefits from a good governing of the alternation between the fluid flows through a same channel, the liquid flow in one direction and the air flow in the opposite direction.

It is in this context that the invention aims at proposing a head for the delivery of drops that is more efficient in maintaining the sterility of the liquid and that is particularly simple and cheap to manufacture.

SUMMARY OF THE INVENTION

To that purpose, the invention proposes to provide the delivery head with an end-piece pierced with a channel for the expulsion of the liquid through which outside air is also allowed to enter back in the reverse direction wherein is placed a valve with a stopper freely movable under the effect of fluid pressures acting thereon inside said channel,which is so mounted as to operate as a non-return valve with respect to the flow of the liquid being and which is made so as to allow itself to be passed through by the air entering from the outside when it is applied against its seat in a position closing the channel to the circulation of the liquid. Letting the gaseous flow pass through in the presence of an aqueous liquid is obtained advantageously by making the valve stopper under the form of a porous mass made of an hydrophobous material. Due to the hydrophobous character of the material it is made of, the valve stopper is prevented from being impregnated with the liquid when it is in the position closing the channel and from remaining impregnated with the liquid passing though it during the stage of liquid expulsion, which could lead to its being obstructed with respect to the flow of air.

According to preferred features of the invention, the valve stopper is realised microporous in its mass and made of an hydrophobous material showing a porosity fineness such that the valve stopper then ensures the anti-bacterial filtration of the air flowing through it. It is remarkable that in usual operating conditions in ophthalmic drop flasks for instance, the presence of such a valve, as proposed by the invention, enables both to control drawing air in through the tip channel after expelling a dose of liquid and to avoid a resulting bacterial contamination by such air entering from the outside.

According to a specific feature of the invention, the end of the end-piece has a hole for the expulsion of liquid drop by drop that is surrounded by a peripheral bulge. This ensures the convenient separation and dropping of a drop of liquid leaving the end-piece, which allows a repeatable calibration of the drop.

According to secondary features of the invention, the end-piece comprises a cavity formed on the path of the expulsion channel in which the valve stopper finds place, at least in part. The valve stopper is thus maintained inside the drop delivery head during its displacements between the open position for the passage of the liquid being expelled and the closed position letting only the air drawn in pass backwards.

According to preferred embodiments of the drop delivery head of the invention, the valve is of the type of a ball valve, the valve stopper having then the shape of a ball and this ball being entirely housed in the valve cavity. The ball shape here should be understood as meaning preferably a spherical shape, able to take freely any direction in the cavity and to move in an isotropic manner in all directions inside the cavity, but the spherical form is not a strictly limitation in implementing the invention and notably oval or oblong shapes can be convenient as well. In other embodiments the valve stopper may have the shape of a pin having two inflated parts on each side of a neck so that it be received partly inside the cavity and partly outside it, further than the terminal orifice of the expulsion channel, and guided axially at the level of that orifice in all its displacements.

According to another feature of the invention, centripetal channels are formed in the walls of the cavity receiving the valve stopper all around the expulsion orifice. These channels are open to the flow of liquid around the valve stopper when in the open position and act in spreading the liquid flux that serves to form a drop for delivery. They are arranged away from the surface that forms the seat on which the valve stopper rests when in the closed position, so as not to interfere with the role of the valve with respect to the air flow, which consists in inhibiting the passage of any return of outside air other than through the valve stopper.

The solution proposed by the invention is advantageously combined with the presence of an anti-bacterial filtering membrane interposed at the base of the end-piece across the delivery head. Such a membrane is used conventionally in the applicant's devices for ophthalmic drops to prevent contamination of the liquid contained in reserve in the bottle by bacteria coming from the outside. The valve proposed, when with a stopper acting as a bacterial filter, carries out an additional filtration concerning the air entering the portion of the delivery head that is situated in the dropper end-piece, downstream the filtering membrane (the downstream side being determined with respect to the flowing direction of the liquid when being expelled). The valve also contributes to the alternation between flow of liquid and flow of air that can be provided by a membrane mounted upstream, at the base of the end-piece, through the passage for the incoming air and the expelled liquid, when it is produced partly hydrophilic and partly hydrophobous, as is conventional per se for such purpose. Thus, the delivery head according to the invention makes it possible to have a valve on the return path for the air after the expulsion of the liquid, which, ahead said membrane, carries out both the anti-bacterial air filtration and such flow alternation in a manner that is complementary to the same functions that are performed by an anti-bacterial membrane made partly hydrophilic and partly hydrophobous.

In the context of applying the features that are set out here, a further subject of the invention is a delivery head for delivering liquid drop by drop comprising a flow-regulating pad housed in the body of an insert for mounting said head in the neck of a bottle and preceding the dropper end-piece on the expelling path for the liquid, as well as a bottle for conditioning a liquid to be delivered drop by drop comprising such a delivery head and a reservoir for storing the liquid the peripheral walls of which have reversibly elastic deformation in order to cause the expulsion of liquid from the reservoir and allow air to enter back into this reservoir in replacement of the expelled liquid. As has been explained in prior art patent documents filed by the instant applicant company, the flow-regulating pad does not only act to regulate the flow of liquid pushed out from the reservoir when the deformable walls are compressed, but it also has an effect on the entrance of air when the walls return to their original state as regards the pressure equilibrium between the upstream side and the downstream side.

It can be observed that in such a bottle, the alternation between the liquid expulsion and the return of air and the purification of the air flowing back through the delivery head towards the bottle are effected on several levels, namely through the microporous pad, through the valve with its movable stopper moved in the end-piece due to the sole pressures to which it is subjected, and through the bifunctional membrane between them two.

BRIEF DESCRIPTION OF THE DRAWINGS

Other features and advantages of the invention will be more apparent from the following description as illustrated by the following drawings.

DETAILED DESCRIPTION OF THE INVENTION

Figure 1A:
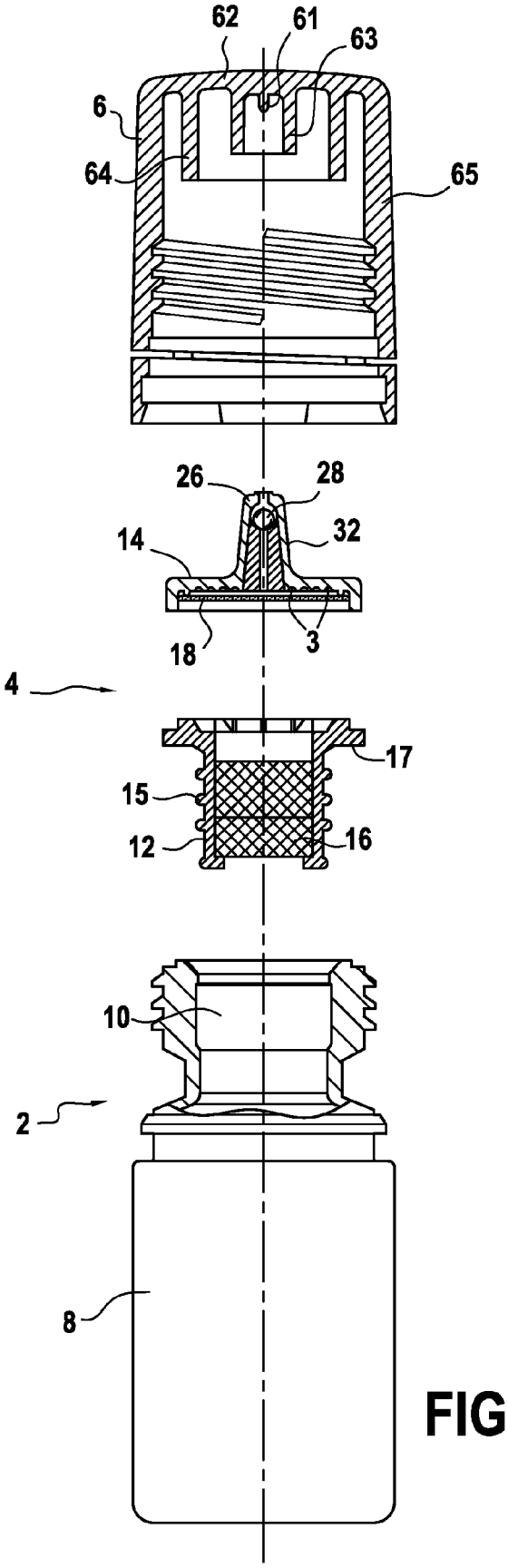
FIG. 1A, which represents in exploded view the various elements forming the bottle of FIG. 1, seen in axial section.
Figure 1:
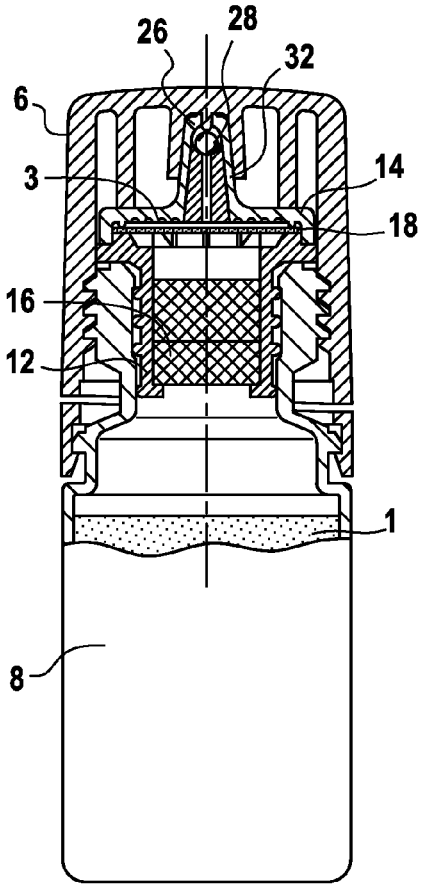
FIG. 1, which represents in axial section a bottle according to the invention.

A bottle for packaging a liquid to be delivered drop by drop is illustrated in FIGS. 1 and 1A in the form of a bottle designed more particularly for conditioning a collyrium (eye-drop aqueous composition). The composition of the latter may advantageously satisfy a formula containing no preservative, because of the high quality of the antibacterial preservation provided according to the invention.

This bottle according to the invention comprises a receptacle 2 with a liquid-storage reservoir 8 inside it and a liquid delivery head 4 that is mounted in a neck 10 of the receptacle at an end of the reservoir and closes that reservoir. A removable cap 6 is provided for covering the delivery head when the bottle is not being used by a user. The neck 10 has a thread on its outside surface that is provided for cooperating with a thread of the removable cap for closing the bottle.

The reservoir 8 comprises a cylindrical peripheral wall with reversible elastic deformation. This allows the liquid to be delivered on the basis of a manual compression applied to the reservoir wall by the user, and after this compression the wall returns spontaneously to its initial shape in connection with the admission of outside air. The entrance of air in compensation for each drop of liquid expelled occurs back in the reverse direction along the same path through the delivery head mounted in the neck of the bottle, and notably the same central channel is used for the flow of air and for the flow of liquid. No other entrance of air is possible; in particular there is no pressure-balancing hole pierced through the outer wall of the bottle and opening in the reservoir of liquid.

The drop delivery head comprises a part internal to the bottle, formed by an insert 12 that is placed inside the neck 10, and an external part forming an end-piece 14 for delivering drops (or dropper tip). A flow-regulating pad 16 is interposed across the central duct passing through the delivery head, in the hollowed body of the insert 12, while an antibacterial filtering membrane 18, also interposed across the central duct, is placed at the base of the end-piece; it is clamped at its periphery between the insert and the end-piece. It is understood that the insert 12 is a mounting support for the pad 16 and the membrane 18 and that it is itself mounted fixed and sealed onto the bottle.

On the top edge of the insert a peripheral ring 17 is formed which plays the role of an abutment for stopping translation when the insert is assembled by force-fitting inside the neck of the bottle. This is made possible by a slight elastic deformation ability shown by the material the insert is made of. The seal at the fitting connection is implemented by the presence of circular o-rings 15, or so-called flutes, that are arranged at the periphery of the insert. These o-rings are preferably made of the same material as the insert, and moulded therewith in the same manufacturing step. They ensure sealing at the contact with the inner wall of the neck and the sealed mounting of the insert mentioned above.

The insert has a generally cylindrical shape and it houses in its inner recess the flow-regulating pad 16, which is of a cylindrical shape closely matching that of the recess. The connection between the two parts is sealed as explained above, both with respect to the liquid and with respect to the air.

The pad 16 is made of a microporous material made out of a hydrophobous matter, and it can notably take the form of a felt with a polyethylene weft. Thence, it cannot become impregnated with the liquid passing through it and it does not tend to retain within itself traces of liquid which would block its pores and close them to any subsequent flow of air.

Its flow-regulating role arises from its microporous structure. In the direction of the liquid flow it has effect to prevent liquid from passing from the reservoir to the end-piece in the absence of a sufficient compression of the wall of the receptacle exerted when the flexible wall of the reservoir is pressed manually in order to force the liquid through the pad. In the direction of the gaseous flow, it causes a pressure drop on the path of the incoming air drawn back through the same way, which retards the balancing of the pressures between the inside and the outside of the bottle when, the compression of the reservoir having ceased, the reservoir is inflated by the spontaneous return of its walls to the original shape, while the removable cap is not yet in place to close the dropper end-piece. In an example of such a flow-regulating pad, conventional in itself, the pad structure is that of a felt of intermingled threads at a density corresponding to a pore diameter of the order of 50 microns.

The anti-bacterial filtering membrane 18, with its bifunctional ability as partly hydrophilic and partly hydrophobous, is placed downstream of the pad and upstream of the end-piece across the flow path of air entering from the outside through the end-piece and across the path of the liquid leaving the reservoir down to the end-piece. The bifunctional character of the membrane makes it possible to ensure the alternating flow of the liquid in one direction and of the air in the other direction. The same membrane is used as an anti-bacterial membrane preventing the passage of impurities when the air enters back into the bottle. This membrane is fixed on its periphery by heat-sealing of lugs between a peripheral ring at the base of the end-piece and a cooperating bearing surface of the insert. The membrane may consist of a polymer material, based for example on polyethersulfone, which is normally hydrophilic but is made hydrophobous on a portion of the surface of the membrane. It has a pore-diameter porosity of the order of 0.1 to 0.2 micrometers.

The cap 6 is suitable for being screwed in a known manner onto the bottle neck, and in this screwed position it closes off the end of the expulsion channel. By thus closing off the inside of the delivery head to the air outside the bottle, placing the cap also makes it possible to prevent the delivery head from completely drying out and the phenomenon of valve sticking is thereby prevented.

The cap 6 is formed of a hollow cylinder closed at one end and comprising, inside the cylinder, a central pin 61 protruding from the end radial wall 62. The cap also comprises two concentric shafts 63 and 64 between the central pin and the peripheral side wall 65. The pin is designed to interact with an expulsion hole of the end-piece in order to close the latter while the shafts 63 and 64 are designed to rest against the outer surfaces of this end-piece, with the one resting radially on the periphery of its slim axial portion and the other resting axially on its transverse base portion.

The dropper end-piece of the delivery head will now be described in detail based notably on FIGS. 2 and 3.

The end-piece 14 is pierced in its centre with a central channel 22 which extends from its base 23 to an expulsion hole 24 for expelling the liquid, situated at the end of its slim axial portion, in the upper end wall 25, considering the bottle placed upright. The base of the end-piece comprises, on its inner face, microchannels 3 which facilitate the drainage of the liquid from the whole surface of the membrane 18 to the expulsion hole.

A peripheral bulge 29 is formed at the end of the end-piece, it protrudes from the top end wall towards the outside of the end-piece, around the expulsion hole. When liquid is expelled through the hole, the peripheral bulge is effective in separating the drop and letting it drop, more particularly in order to obtain a calibrated drop repeatably on each delivery.

A central core 30 extends inside the central channel from the base in the direction of the top end wall. That core has a shape to match that of the central channel in which it is housed, that is to say a generally cylindrical shape. Its outer diameter is adjusted to the inner diameter of the central channel so that neither air nor liquid can flow here between the central channel and the core. The central core is however pierced at its centre in order to form the expulsion channel 32 for the liquid to be delivered drop by drop. The axial dimension of the core is less than the axial dimension of the central channel so that the upper end surface of the core extends at a distance from the top end wall of the end-piece when the core is in place in the end-piece.

A spherical cavity 33 is then formed, as delimited by the inner surface of the walls of the end-piece body and by that of its inner core at its top end. The cavity is arranged on the path of the expulsion channel 32, close to the expulsion hole 24. The cavity emerges upstream on the central channel and downstream on the expulsion hole, so that the liquid expelled from the bottle through the expulsion channel is made to pass through this cavity, and the air is also made to enter the bottle in compensation.

The end-piece is fitted with a ball valve 28 that is formed at the end of the expulsion channel at the level of the cavity 33 and which comprises a ball stopper moving freely in the cavity 33. It is observed that the top end surface of the core 30 has a spherical profile forming a valve seat 36 suitable for interacting with a spherical ball forming the movable stopper of the valve due to its sealed contact with an annular zone around the channel mouth.

Figure 2:
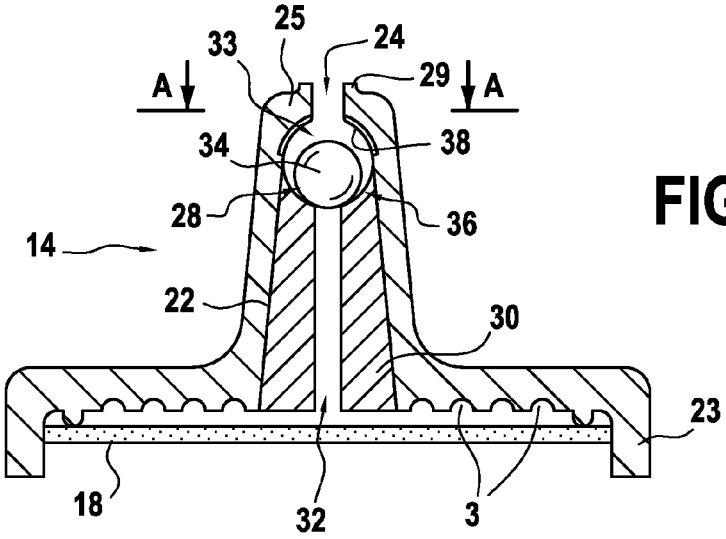
FIG. 2, which represents in axial section the end-piece for delivering drops from the bottle of FIG. 1.
Figure 3:
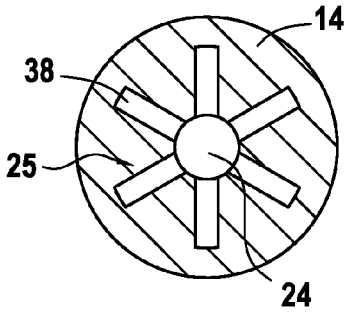
FIG. 3, which is a view in section along A-A of the end-piece of FIG. 2, showing notably its internal channels.

In the embodiment of the invention illustrated in FIGS. 1 and 2, the stopper of the ball valve takes the shape of an actual ball of spherical shape that is entirely contained within the cavity. This ball can move in the cavity between two extreme positions that are axially opposed to each other, namely a first closing position in which the ball rests on the valve seat formed by the end surface of the core and a second delivery position in which the ball is pressed against the top end wall of the end-piece.

The valve stopper is made of a porous material with hydrophobous properties. The diameter of the pores is in the present instance less than 0.2 pm, which allows for anti-bacterial filtration of the air flowing through the valve. Accordingly, provision may also be made, as a variant, to confer to the valve stopper an anti-bacterial treatment by using a polymer material with intrinsic bactericidal effect, such as may be notably polymer materials incorporating silver ions.

The ball is adapted to rest on the valve seat 36 formed at the bottom of the cavity (the bottle being considered as resting vertically) when no pressure is exerted on elastically reversible deformable walls of the receptacle. The valve seat shows a curved profile with a radius adapted to that of the ball so that there is no possible flow of air between the ball and the top end surface of the core when the ball is resting on its seat. Such complementarity of the spherical shapes is particularly interesting for the present case of a ball stopper freely movable in all directions in the cavity with no other solicitation acting thereon other than fluid pressure effects.

When the valve is in this closing position, the ball resting on its seat, the liquid expulsion circuit is closed. A manual pressure on the deformable walls of the receptacle causes the ball to move away from its seat under the pressure of the liquid pushed out from the reservoir, and that liquid pushed out is permitted to flow aside the stopper out of the expulsion hole. It should be noted that simply turning the bottle upside down cannot cause this movement of the ball because of the presence of the flow-regulating pad.

After the delivery of liquid, the pressure on the deformable walls of the receptacle is released which creates a lower pressure therein and thence tends to cause the closure of the valve while aspirating outside air, and while the ball returns upon its seat, the traces of liquid not delivered are drawn back inside the bottle and outside air is drawn through the stopper of the closed valve. It is clearly observed that the volume of excess liquid to be returned into the bottle is infinitesimal. When all the liquid has passed beneath the ball, the seal is then completely ensured since the ball can rest fully against the seat. The porous character of the valve, for its part, lets air pass through the valve in all circumstances, and notably when the valve is in the closing position, that is to say when there is no longer any residual liquid between the seat and the ball of the valve.

This therefore gives, in the closed-off position, when the delivery of liquid is finished, a passage of filtered air past the ball in order to allow the reservoir to fill with air in compensation for the expelled liquid, after the excess liquid has passed to the reservoir. It is important on the one hand to allow the passage of air to the inside after delivery so that the bottle resumes its original shape and allows the correct subsequent delivery of liquid, and, on the other hand, to preserve the sterility of the product still present inside the receptacle.

Due to its passing from the open position to the closed position and the reverse, the valve stopper, already on its own, ensures at the dropper end-piece the alternation between liquid flow and air flow. The same alternation is ensured furthermore by the bifunctional membrane. The valve also has the effect, through the chosen porosity fineness, of forming a barrier to the bacteria present in the outside air while allowing the filtered air to pass, just as the bifunctional membrane does further on.

As has just been described, the ball is suitable for passing from a closed-off position against the seat of the valve to an open position of the duct for expelling the liquid in which the ball butts against the top end wall of the end-piece, around the expulsion hole. The dimension of the cavity 33 and the dimension of the ball are determined so that the movement of the ball from one position to the other is slight, just sufficient to perform the valve function, in an advantageous compromise with the need for a rapid return of the ball to its seat in order to close the way to the outside air.

Centripetal channels 38 are formed as grooves cut out in the wall delimiting the cavity, inside the end-piece. They are present in the top half of this cavity, that is to say the half close to the expulsion hole, and they lead to the expulsion hole. Thanks to their small section and to capillary effects these channels practically do not let air be admitted prematurely when they have been filled with liquid. As illustrated in FIG. 3, these channels are angularly distributed all around the cavity.

The elements forming the delivery head generally consist of a polymer material compatible with the application for contact with an ophthalmic solution. They are notably each made of a polymer from the polyethylene family.

Advantageously, the end-piece incorporates in a solid block a polymer carrying ions with a bactericidal effect. The latter is chosen to be compatible with the conventional plastic material of the end-piece. Even if only for this reason, it is preferably made of a polyethylene material. It is available on the market in the form of powder or of granules or pellets, ready to be incorporated into the moulding composition of the end-piece. The bactericidal agent preferably consists of silver ions which are carried by the polymer macromolecules.

The end-piece according to the invention is manufactured according to a conventional moulding process. After the moulding, the bactericidal agent is present in the whole block of the end-piece, and in particular both on its outer surface capable of coming into contact with the eyes or the hands of the user, and on its inner surface delimiting its central channel.

The central core of the end-piece is manufactured by a moulding process from the same base material, notably made of polyethylene, similarly to the body of the end-piece that surrounds it. Since the valve placed downstream of the core blocks the return of liquid and ensures an anti-bacterial filtration on the outside air flowing-in in compensation, it is possible to envisage not carrying out an anti-bacterial treatment of the core. However, such a treatment may be carried out and the core then advantageously comprises a bactericidal agent that is different from that contained in the body and has effect on the outer surface of the end-piece. This bactericidal agent is triclosan, as an example in this instance, since that chemical compound has a broad anti-bacterial spectrum.

The mounting of the delivery head according to the invention will now be described.

The ball is mounted inside the end-piece by inserting it through the base and making it raise through the axial central duct. The ball is brought in abutment against the inner face of the top end wall of the end-piece. The core is then inserted into the central duct and forced in engagement therein. An annular groove (not shown) is formed at the base of the core is placed to come up against a boss (also not shown) the shape of which matches the shape of the groove. The two elements interact by an elastic snap-fitting effect in order to ensure a firm hold of the core inside the channel.

The cavity of the ball valve is thus formed as delimited by the top end wall and the side walls of the end-piece and by the end surface of the core. The ball is trapped in the cavity, it is able to move freely between the two extreme positions which are axially opposed to each other along the path in the central duct in which it comes in abutment against the cavity wall.

Finally, the membrane is placed on the base of the end-piece and the membrane is sealed at its periphery, before sealing the assembly thus formed at the insert.

The bottle thus formed is used for delivering a liquid drop by drop. The user removes the cap and then presses the walls of the reservoir in order to make the drops of liquid come out. After use, the cap is put back in place. As appears from FIG. 1, the cap contributes, through its central pin 61 which blocks the expulsion hole, to returning and holding the valve stopper against its seat.

A variant embodiment, illustrated in FIG. 4, will now be described in which a delivery end-piece 114 is generally similar to the end-piece 14 described above except that the shape of the valve 128 differs. In this variant, the ball of the valve is replaced by a pin 40 with a head 42 suitable for being housed in the cavity and a frustoconical portion 44 that interacts with the outer face of the expulsion hole.

It will be understood that, in this variant embodiment, the expulsion hole has a cross section that is different from the cross section of the hole of the embodiment described above, with the walls delimiting this hole that are beveled and that are therefore adapted to interact with the frustoconical portion of the valve.

The valve 128 (more precisely its movable stopper) is mounted by force fitting through the expulsion hole until the head is in the cavity. Accordingly, advantageously, no core is provided in the end-piece, as was shown in FIG. 4, the expulsion channel being formed directly by a piercing in the centre of the end-piece. The cavity 33 is therefore formed only by inner walls of the end-piece, without the presence of a core. For reasons of ease of production, it is possible to provide an end-piece cut into two portions, each portion comprising a hollow forming the cavity when the portions are assembled against one another. It is also possible to provide two portions to be assembled one on head of the other, with an upper portion that comprises the seat and the valve and a lower portion that forms the central channel.

In use, the frustoconical portion of the valve which comes out of the end-piece is adapted to close the expulsion hole from the outside of the end-piece when the excess liquid and the air are drawn back into the bottle. In this instance, it is the frustoconical portion 44 and the head end wall of the end-piece 125 which form respectively the stopper and the seat of the valve. The seal is made between the frustoconical portion and the head end wall of the end-piece, on the outside of the end-piece, unlike in the embodiment previously described in which the seal was made on a seat inside the cavity.

Since the only role of the head in this instance is as an abutment, its shape and its dimension are of less importance than in the embodiment previously described. The ovoid shape of the head shown in FIG. 4 makes it easier to force fit into the expulsion hole, the diameter being sufficient to form an abutment against the wall when the head is in the cavity and the head being flattened to reduce the weight of the assembly. It is to be noted here that the valve stopper is guided linearly during its displacements, namely when moving through the end-piece wall at the level of the expulsion hole.

As above, the valve stopper moves under just under pressure effects. A higher pressure upstream to eject some liquid tends to push it out of its seats, and on the reverse a lower pressure drawing outside air in tends to set it close to its seat, in sealed contact with it, so that the air drawn from outside has to pass through the stopper. In this variant, the closed-off position is obtained by contact of the frustoconical portion 44 of the movable stopper on the beveled walls 126 delimiting the hole while the delivery position is obtained by contact of the head against the inner face of the head end wall of the end-piece, which forms a means of abutment to the movement of the stopper of the valve.

Here, the valve is also made of a hydrophobous porous material. As above, the fineness of porosity is chosen to ensure the bacterial filtration of the outside air entering the bottle, while the hydrophobous character of the material makes it possible to ensure that the valve in the closing position of the channel can be traversed by the entering air flow.

The end-piece also differs in that no bulge is provided for the separation and calibration of the drop. In this instance it is the stopper of the valve in its outer frustoconical portion that performs this function.

Figure 4:
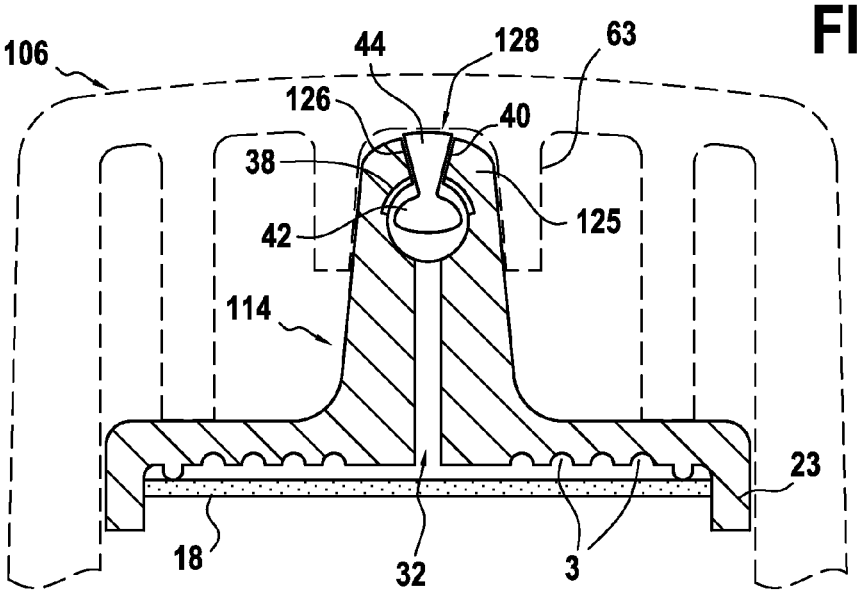
FIG. 4, which represents a variant embodiment of the end-piece, in a view similar to that of FIG. 2, with the associated cap shown in dashed lines.

Moreover, the presence of the valve in the expulsion hole involves a different shape for the cap, as shown in dashed lines in FIG. 4. The cap contains no central pin. However, as above, the pressure of the inner shaft against the outer wall of the end-piece on its periphery tends to push the aspirated air towards the inside of the bottle and to press the stopper against its seat.

The foregoing description clearly explains how the invention makes it possible to achieve the objectives that it has set itself. On its own, the valve produced according to the invention is adapted to manage the alternation between the passage of the liquid expelled from the bottle it is fitted to and the passage of the air drawn in through the same way in compensation for the consumed liquid. In the complete delivery head as has been described here, an additional role of the membrane and of the valve is therefore obtained in the alternation of the flow of liquid and the flow of air along the same path. Equally in the role of bacterial protection, the valve has effect by itself at the level of the end-piece, but it also contributes thereby to the same function as that performed downstream by the filtering membrane. It will be noted that, in the preferred embodiment of the complete delivery head, the flow-regulating pad also has an effect in the function of alternating liquid flow and air flow.

The drop delivery head according to the invention distinguishes from those known already by the presence of the ball valve or similar valve in the end dropper piece, on the liquid expelling duct (or channel). The valve stopper is movable between an open position letting the liquid pushed out of the flask pass and a closed position where it is applied against its fixed seat and closes the duct, thereby prohibiting air from entering in the flask back from downstream to upstream. It is freely movable in the axial direction and can move between the two positions under the only effect of pressure differences between upstream pressure and downstream pressure.

It microporous structure and its hydrophobous character in the mass result in its letting selectively pass air while being waterproof. When it is pushed outwards by the liquid being expelled and it comes in abutment on the walls of the cavity wherein it is retained, the liquid (herein an aqueous liquid like an eye-drop liquid) cannot pass through it but can only circulate around it and flow out through the channels managed therefore down to the end hole. When on the reverse the pressure is lowered inside the flask, the stopper is pulled inwards and air is drawn in from outside, thence it comes in abutment on the cavity bottom, and in that position wherein the valve is closed it is in sealed contact with the cavity wall all around the end mouth of the end-piece axial duct. Thence, due to its flowing not around but throughout the valve stopper, only outside air can nevertheless enter the flask and occupy the volume left void by the liquid expelled therefrom.

Of course, the embodiments that have been described ub details above are not limitating for the invention. In any case, the invention cannot be restricted to the embodiments that have been specifically described and it extends in particular to any equivalent means and any technically operative combination of these means.

What is claimed is:

1. A delivery head for delivering a liquid drop by drop comprising an end-piece pierced with a channel for the expulsion of the liquid through which air also enters back in the reverse direction, characterized in that said delivery head comprises at a level of the end-piece a valve operating as a non-return valve with respect to flow of the liquid, said valve comprising a stopper that is retained in a receiving cavity provided on said channel path and which is movable relative to a seat onto which said stopper applies in a closed position of the valve under only the effect of pressure differences acting on the stopper, said valve stopper being so made of a hydrophobous material as to selectively let air flow through stopper when stopper is applied against said seat.

2. The delivery head according to claim 1, characterized in that the valve stopper is made of a porous material.

3. The delivery head according to claim 2, characterized in that said porous material the valve stopper is made of is of such fine porosity as to constitute an anti-bacterial filter.

4. The delivery head according to claim 1, characterized in that an end of the end-piece comprises a hole for liquid expulsion drop by drop that is surrounded by a peripheral bulge.

5. The delivery head according to claim 1, characterized in that the valve stopper is adapted to move axially in said cavity.

6. The delivery head according to claim 1, characterized in that the valve stopper has the shape of a ball entirely housed in said cavity and is freely movable therein in all directions.

7. The delivery head according to claim 1, characterized in that the valve stopper shows the shape of a pin with a head suitable for being housed in the cavity and a frustoconical portion which extends out of the cavity and which interacts with a hole for expulsion of liquid drop by drop provided at an end of the end-piece.

8. The delivery head according to claim 1, characterized in that centripetal grooves are provided in the walls of the cavity and form channels letting the liquid flow through when the stopper abuts against a wall of the cavity in an open position of the valve.

9. The delivery head according to claim 1, characterized in that a bifunctional membrane, which is partly hydrophilic and partly hydrophobous to ensure alternating flow between expelled liquid and incoming air, is mounted at a base of the end-piece.

10. The delivery head according to claim 9, wherein said membrane presents such fine porosity as to exhibit an anti-bacterial filtering activity for the outside air.

11. The delivery head according to claim 1, characterized in that the head comprises a flow-regulating pad housed in a body of an insert preceding the end-piece on a path of expulsion of the liquid, said pad being made of a hydrophobous material.

12. A bottle for packaging a liquid to be delivered drop by drop, characterized in that said bottle comprises a delivery head according to claim 11 and a reservoir for storing the liquid, peripheral walls of which deform elastically and reversibly in order to promote expulsion of liquid from the reservoir and allow air to return into the reservoir in replacement of the expelled liquid, the pad regulating a flow rate of liquid expelled from the reservoir when the deformable walls are pressed and creating a pressure drop on entry of air as a balance of pressures between inside and outside the bottle.

13. The delivery head according to claim 1, characterized in that the retaining cavity for the valve stopper is provided between a free end of the end-piece pierced with a drop expulsion hole and a central core occupying an inside of the end-piece body through which the liquid expulsion channel is axially provided.

14. A delivery head for delivering a liquid drop by drop comprising an end-piece pierced with a channel for the expulsion of the liquid through which air also enters back in the reverse direction, characterized in that said delivery head comprises at a level of the end-piece a valve operating as a non-return valve with respect to flow of the liquid, said valve comprising a stopper that is retained in a receiving cavity provided on said channel path and which is movable relative to a seat onto which said stopper applies in a closed position of the valve under only the effect of pressure differences acting on the stopper, said valve stopper being so made as to selectively let air flow through stopper when stopper is applied against said seat, wherein the valve stopper shows the shape of a pin with a head suitable for being housed in the cavity and a frustoconical portion which extends out of the cavity and which interacts with a hole for expulsion of liquid drop by drop provided at an end of the end-piece.

* * * * *